US005441153A

United States Patent [19]

Lahaye

[11] Patent Number: 5,441,153

[45] Date of Patent: Aug. 15, 1995

[54] LIPSTICK AND CONTAINER SYSTEM

[76] Inventor: Cindy L. Lahaye, 10543 Kirkgreen Dr., Houston, Tex. 77089

[21] Appl. No.: 204,962

[22] Filed: Mar. 2, 1994

[51] Int. Cl.[6] ..... B65D 85/30

[52] U.S. Cl. ..... 206/581; 132/312; 383/38; 206/823

[58] Field of Search ..... 206/581, 823, 443; 132/312, 314, 316, 297, 294, 301; 383/38, 39

[56] References Cited

U.S. PATENT DOCUMENTS

| | | | |
|---|---|---|---|
| 505,222 | 9/1893 | Hoff | 206/479 |
| 2,042,584 | 6/1936 | Bustamante | 132/316 |
| 2,454,718 | 11/1948 | Russo | 206/823 X |
| 2,497,314 | 2/1950 | Libson | 132/314 |
| 2,497,950 | 2/1950 | Lohr et al. | 132/314 |
| 3,311,142 | 3/1967 | Zalk et al. | 383/38 X |
| 4,648,505 | 3/1987 | Belmondo | 206/372 X |
| 4,858,765 | 8/1989 | Nakamura et al. | 132/316 X |
| 5,002,401 | 3/1991 | Blackman | 383/38 |
| 5,329,947 | 7/1994 | Shikler | 132/316 X |

*Primary Examiner*—Steven N. Meyers
*Assistant Examiner*—BethAnne C. Cicconi

[57] ABSTRACT

A new lipstick case for containing a plurality of tubes of lipstick to organize and protect the lipstick while being carried in a handbag or the like is disclosed. The lipstick case comprises a holder formed of resilient transparent plastic (either hard or soft plastic) having a plurality of vertically aligned open-top elongated chambers therein. The chambers each have dimensions to snugly receive an outer protective tube of a conventional cosmetic lipstick. The lipstick is inverted within the chamber such that the base of the lipstick may be readily viewed and easily grasped by a user to withdraw the coloring medium from the protective outer tube while retaining the tube within the chamber. A top closure flap is integrally transversely formed on the holder whereby lipstick tubes contained therein are prevented from inadvertently falling out of the chambers. A fastener for holding the top closure flap closed is also included. In an alternate embodiment, the lipstick case additionally includes a rectangular mirror mounted lengthwise on an inside surface of the top closure flap whereby application of the lipstick on the lips of the user is facilitated by the image reflected thereon.

1 Claim, 3 Drawing Sheets

LIPSTICK AND CONTAINER SYSTEM

BACKGROUND OF THE INVENTION

1. Field of the Invention

The present invention relates to cosmetic cases and more particularly pertains to lipstick cases which may be adapted for containing a plurality of tubes of lipstick to organize and protect the lipstick while being carried in a handbag or the like.

2. Description of the Prior Art

The use of cosmetic cases is known in the prior art. More specifically, cosmetic cases heretofore devised and utilized for the purpose of holding cosmetics are known to consist basically of familiar, expected and obvious structural configurations, notwithstanding the myriad of designs encompassed by the crowded prior art which have been developed for the fulfillment of countless objectives and requirements.

The present invention is directed to improving devices for containing a plurality of tubes of lipstick to organize and protect the lipstick while being carried in a handbag or the like in a manner which is safe, secure, economical and aesthetically pleasing.

For example, U.S. Pat. No. 4,326,546 to Acker discloses a combination lipstick display and storage container for a lipstick tube in which the lipstick is mounted in front of a mirror of a appropriate rectangular shape such that the mirror reflects the image of the lipstick to a potential customer and thus enhances the point-of-sale presentation thereof, and after purchase the mirror can be held in a generally horizontal orientation and has adequate length for the user to see enough of a reflected image of her lips to assist in the application of the lipstick mass.

The prior art also includes the following patents of interest: U.S. Pat. No. Des. 247,123 to Benes which discloses a lipstick tube holder, U.S. Pat. No. Des. 288,012 to Sussman showing an organizer for lipsticks and similar articles, U.S. Pat. No. Des. 301,771 to Bakie which describes a cosmetic case, and U.S. Pat. No. Des. 306,220 to Wang showing a lipstick container.

While these devices fulfill their respective, particular objectives and requirements, the aforementioned patents do not disclose a lipstick case for containing a plurality of tubes of lipstick to organize and protect the lipstick while being carried in a handbag or the like.

In this respect, the lipstick case according to the present invention substantially departs from the conventional concepts and designs of the prior art, and in so doing provides an apparatus primarily developed for the purpose of containing a plurality of tubes of lipstick to organize and protect the lipstick while being carried in a handbag or the like.

Therefore, it can be appreciated that there exists a continuing need for new lipstick cases which can be used for containing a plurality of tubes of lipstick to organize and protect the lipstick while being carried in a handbag or the like. In this regard, the present invention substantially fulfills this need.

As illustrated by the background art, efforts are continuously being made in an attempt to develop devices for holding cosmetics. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of cosmetic cases now present in the prior art, the present invention provides a new cosmetic cases construction wherein the same can be utilized for containing a plurality of tubes of lipstick to organize and protect the lipstick while being carried in a handbag or the like. As such, the general purpose of the present invention, which will be described subsequently in greater detail, is to provide a new lipstick case apparatus and method which has all the advantages of the prior art cosmetic cases and none of the disadvantages.

The invention is defined by the appended claims with the specific embodiment shown in the attached drawings. For the purpose of summarizing the invention, the invention may be incorporated into a new lipstick case for containing a plurality of tubes of lipstick to organize and protect the lipstick while being carried in a handbag or the like. The lipstick case comprises a holder formed of resilient transparent plastic having sides and a bottom. The holder also has a plurality of divider panels integrally formed therein cooperatively with the sides and bottom whereby a plurality of identical vertically aligned open-top elongated chambers is defined. The chambers each have dimensions to snugly receive an outer protective tube of a conventional cosmetic lipstick. The lipstick is inverted within the chamber such that the base of the lipstick may be readily viewed and easily grasped by a user to withdraw the coloring medium from the protective outer tube while retaining the tube within the chamber.

A top closure flap is integrally transversely formed on the holder whereby lipstick tubes contained therein are prevented from inadvertently falling out of the chambers. The top closure flap has a first vertical portion projecting upwardly from the back side of the holder. A generally horizontal portion extends from the top of the first vertical flap portion toward the front side of the holder. The horizontal flap portion is hingedly connected to the first vertical flap portion with a first integral hinge portion extending transversely thereacross. A second vertical flap portion extends downwardly from the front of the horizontal portion to overlappingly contact the outside surface of the front side of the holder. The second vertical flap portion is hingedly connected to the horizontal flap portion with a second integral hinge portion extending transversely thereacross. Securement means to hold the top closure flap closed is also included. The securement means comprises a strip of hook tape material disposed on the overlapping surface of the second vertical flap portion and a cooperative strip of loop tape material disposed on the overlapped surface of the front side of the holder. In an alternate embodiment, the lipstick case additionally includes a rectangular mirror mounted lengthwise on an inside surface of the top closure flap whereby application of the lipstick on the lips of the user is facilitated by the image reflected thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a lipstick case for containing a plurality of tubes of lipstick to organize and protect the lipstick while being carried in a handbag or the like.

It is another object of the present invention to provide a new lipstick case which may be easily and efficiently manufactured and marketed.

It is a further object of the present invention to provide a new lipstick case which is of a durable and reliable construction.

An even further object of the present invention is to provide a new lipstick case which is susceptible of a low cost of manufacture with regard to both materials and labor, and which accordingly is then susceptible of low prices of sale to the consuming public, thereby making such lipstick cases economically available to the buying public.

Still yet another object of the present invention is to provide a new lipstick case which provides in the apparatuses and methods of the prior art some of the advantages thereof, while simultaneously overcoming some of the disadvantages normally associated therewith.

Still yet another object of the present invention is to provide a new lipstick case that also includes an attached mirror to aid a user in applying the lipstick contained therein.

Yet another object of the present invention is to provide a new lipstick case that is designed to accommodate all conventional lipstick tubes.

Even still another object of the present invention is to provide a new lipstick case that is compact so as to take up little space within a users handbag, cosmetic case, or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
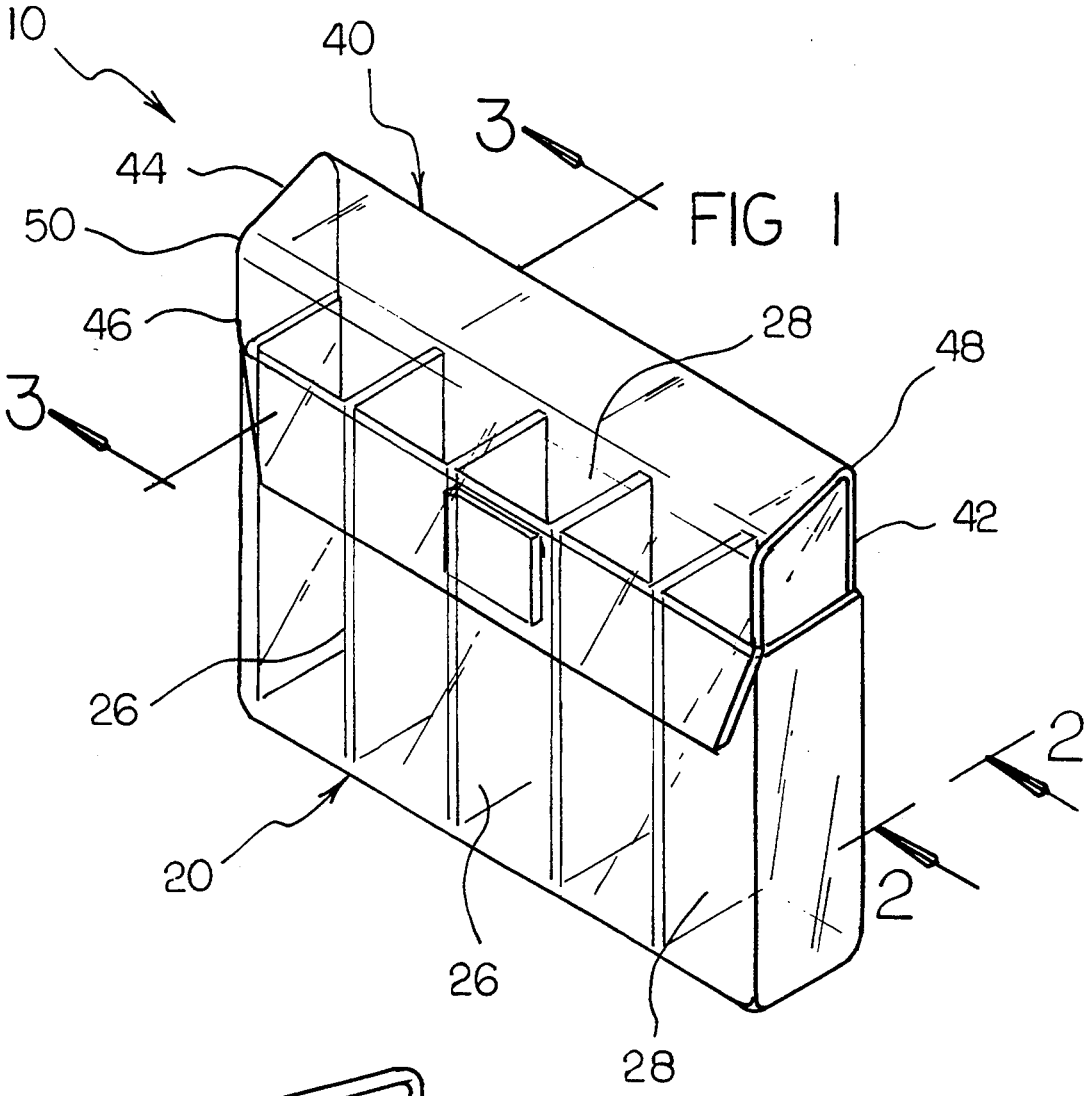
FIG. 1 is a perspective view of the new lipstick case showing the front, top, and left side.

With reference now to the drawings, and in particular to FIG. 1 thereof, a new lipstick case embodying the principles and concepts of the present invention and generally designated by the reference numeral 10 will be described.

Figure 2:
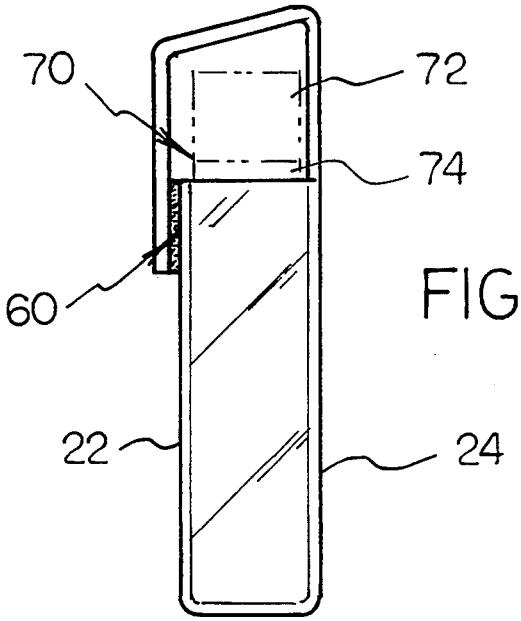
FIG. 2 is a left side elevational view of the present invention illustrating the manner of insertion of a lipstick tube.
Figure 3:
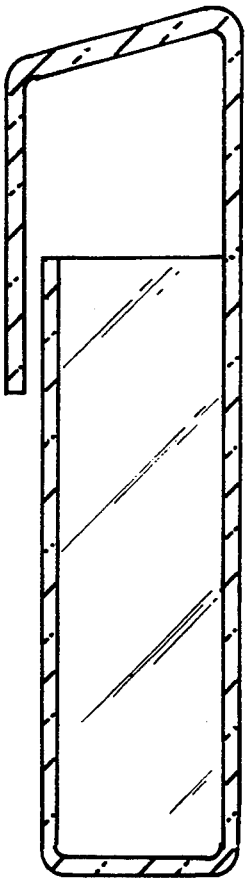
FIG. 3 is a sectional view of the invention of FIG. 1 taken along the line 3—3 and showing the manner of overlap of the top closure flap with the front side of the holder.
Figure 4:
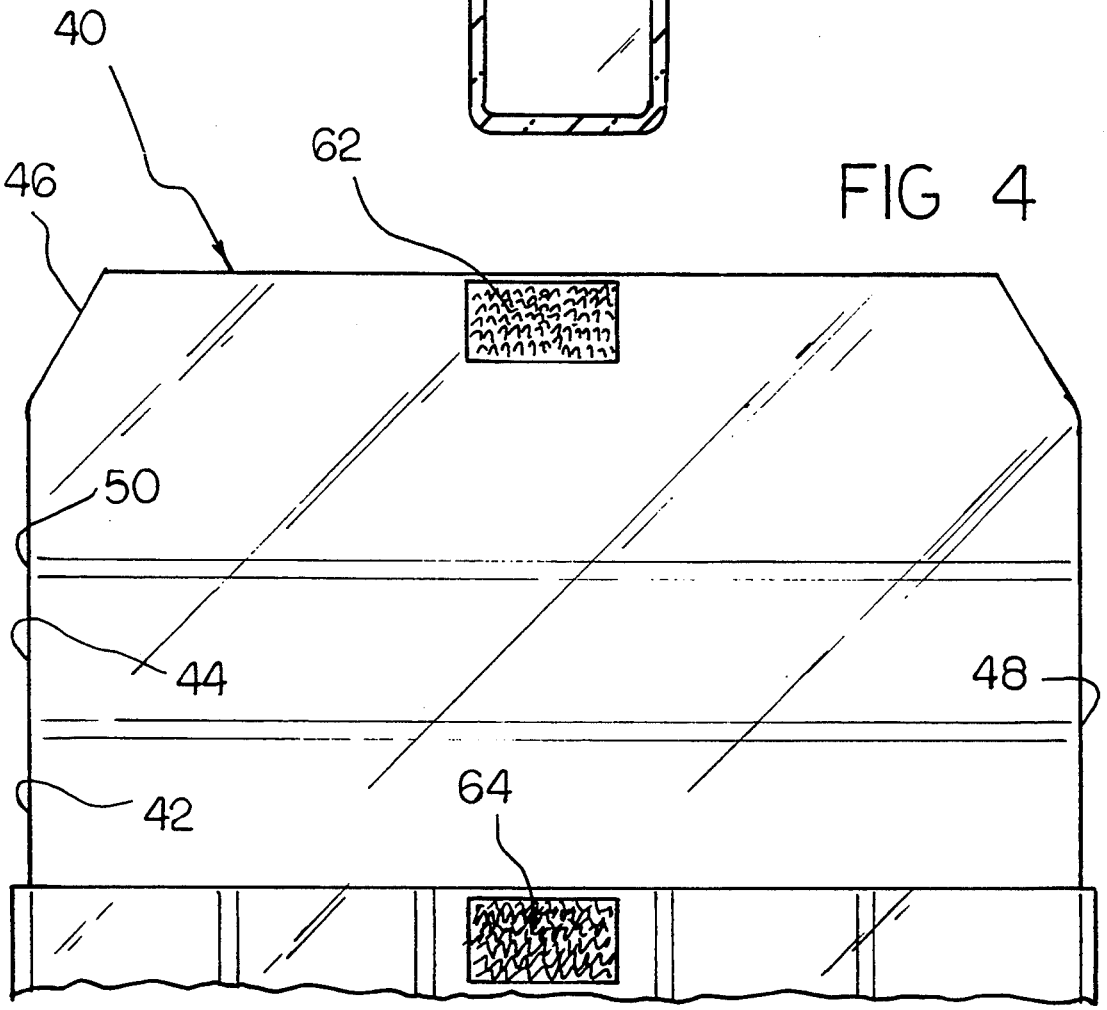
FIG. 4 is a partial front elevational view of the present invention shown with the top closure flap in the open position and illustrating the manner of construction of the top closure flap.

From an overview standpoint, the lipstick case is adapted for use for containing a plurality of tubes of lipstick to organize and protect the lipstick while being carried in a handbag or the like. See FIG. 2.

With reference now to FIGS. 1–4 and more specifically, it will be noted that a new lipstick case 10 for containing a plurality of tubes of lipstick 70 to organize and protect the lipstick while being carried in a handbag or the like, is shown. The lipstick case 10 comprises a holder 20 formed of resilient transparent plastic having sides and a bottom. The holder 20 also has a plurality of divider panels 26 integrally formed therein cooperatively with the sides and bottom whereby a plurality of identical vertically aligned open-top elongated chambers 28 is defined.

The chambers 28 each have dimensions to snugly receive an outer protective tube 74 of a conventional cosmetic lipstick 70. The lipstick 70 is inverted within the 28 chamber such that the base 72 of the lipstick may be readily viewed and easily grasped by a user to withdraw the coloring medium (not shown) from the protective outer tube 74 while retaining the tube 74 within the chamber 28.

A top closure flap 40 is integrally transversely formed on the holder 20 whereby lipstick tubes 70 contained therein are prevented from inadvertently falling out of the chambers 28. The top closure flap 40 has a first vertical portion 42 projecting upwardly from the back side 24 of the holder. A generally horizontal portion 44 extends from the top of the first vertical flap portion 42 toward the front side 22 of the holder. The horizontal flap portion 44 is hingedly connected to the first vertical flap portion 42 with a first integral hinge portion 48 extending transversely thereacross.

A second vertical flap portion 46 extends downwardly from the front of the horizontal portion 44 to overlappingly contact the outside surface of the front side 22 of the holder 20. The second vertical flap portion 46 is hingedly connected to the horizontal flap portion 44 with a second integral hinge portion 50 extending transversely thereacross. Securement means 60 to hold the top closure flap 40 closed is also included. The securement means 60 comprises a strip of hook tape material 62 disposed on the overlapping surface of the second vertical flap portion 46 and a cooperative strip of loop tape material 64 disposed on the overlapped surface of the front side 22 of the holder 20.

Figure 5:
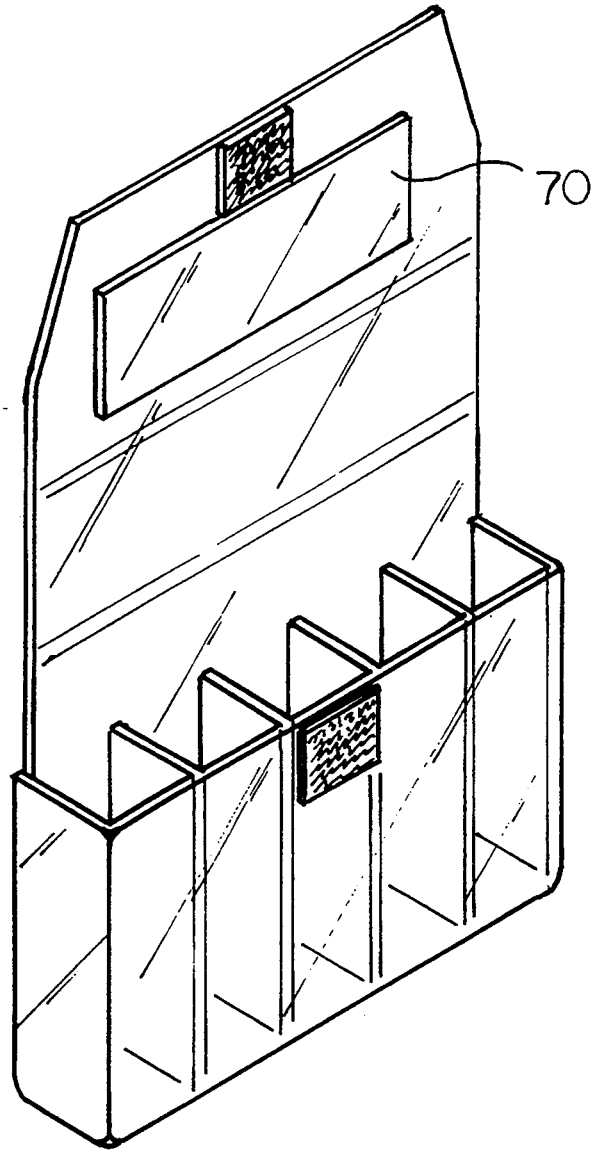
FIG. 5 is another perspective view of the new lipstick case showing the front, right side, and opened top closure flap with the mirror and hook-and-loop tape flap fastener.
Figure 6:
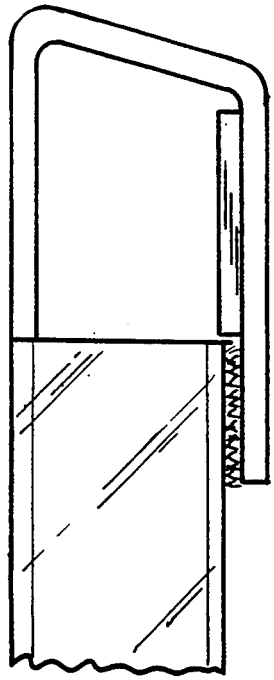
FIG. 6 is a right side elevational detail view of the invention of FIG. 5 illustrating the relative positions of the mirror and hook-and-loop tape fastener.

FIGS. 5 and 6 depict an alternate embodiment of the lipstick case 10 which additionally includes a rectangular mirror 70 mounted lengthwise on an inside surface of the top closure flap 40 whereby application of the lipstick on the lips of the user is facilitated by the image reflected thereon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A lipstick and container system comprising, in combination:

a color medium in tubular form having a lower end and an upper end adapted to paint the lips of a user, the lipstick also having a base with an upper surface coupled to the lower end of the medium, the base also having a lower surface with indicia formed thereon, the lipstick also having a cylindrical side wall with a lower end coupled with to the upper end of the base of the medium and having an open upper end terminating at an elevation to allow the upper end of the lipstick to be exposed during operation and use, the lipstick also having a tubular cover with an open lower end positionable over the medium and side walls in contact with the upper surface of the base, the cover also having a closed upper end to protect the upper end of the medium;

a holder having a front wall and a rear wall in spaced parallel relationship therebetween, the holder also having a bottom wall coupling a lower end of the front wall and rear wall, the holder also having parallel side walls secured to lateral ends of the front and rear walls and secured to a lower end of the upper surface of the bottom wall, the holder also having a plurality of divider panels configured similar to the side walls and positioned at equally spaced locations therebetween, the front and rear walls and adjacent side walls defining box-like spaces for the removable receipt of the lipstick, the lipstick snugly positioned with the upper end thereof adjacent to the bottom wall of the container, the material of the container being transparent, flexible, and resilient whereby the applying of forces by fingers to portions of the container will fixedly position the cover of the lipstick contained therein whereby the base, lipstick and side walls may be withdrawn for use with the cover retained therein;

a cover for the container, the cover formed as an extension of the back wall extending upwardly then at an angle over to cover the container and then downwardly at an angle with closure means thereon.

* * * * *